US009279548B1

(12) United States Patent
Fleming

(10) Patent No.: US 9,279,548 B1
(45) Date of Patent: Mar. 8, 2016

(54) LIGHT COLLIMATING ASSEMBLY WITH DUAL HORNS

(71) Applicant: 3M INNOVATIVE PROPERTIES COMPANY, St. Paul, MN (US)

(72) Inventor: Patrick R. Fleming, Lake Elmo, MN (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 5 days.

(21) Appl. No.: 14/461,719

(22) Filed: Aug. 18, 2014

(51) Int. Cl.

| | |
|---|---|
| ***F21K 99/00*** | (2010.01) |
| ***F21V 7/00*** | (2006.01) |
| ***F21V 7/04*** | (2006.01) |
| ***F21V 7/06*** | (2006.01) |
| ***F21V 7/22*** | (2006.01) |
| ***F21V 29/70*** | (2015.01) |
| *F21Y 101/02* | (2006.01) |

(52) U.S. Cl.
CPC . *F21K 9/54* (2013.01); *F21K 9/137* (2013.01); *F21V 7/0033* (2013.01); *F21V 7/0066* (2013.01); *F21V 7/041* (2013.01); *F21V 7/043* (2013.01); *F21V 7/06* (2013.01); *F21V 7/22* (2013.01); *F21V 29/70* (2013.01); *F21Y 2101/02* (2013.01)

(58) Field of Classification Search
CPC ..... F21K 9/54; F21K 9/137; F21V 7/0033; F21V 7/066; F21V 7/041; F21V 7/06; F21V 7/043; F21V 7/22; F21V 29/70; F21Y 2101/02
USPC ..... 362/346, 347, 349, 296.01, 297, 298, 362/302, 304
See application file for complete search history.

(56) References Cited

U.S. PATENT DOCUMENTS

| | | | | |
|---|---|---|---|---|
| 1,478,898 | A * | 12/1923 | Hachman | F21V 11/00 362/291 |
| 3,941,458 | A * | 3/1976 | Merrow | G02B 17/02 359/859 |
| 4,174,533 | A | 11/1979 | Barthes | |
| 5,803,593 | A * | 9/1998 | Siminovitch | F21V 7/0008 313/234 |
| 6,464,373 | B1 | 10/2002 | Petrick | |
| 6,758,582 | B1 | 7/2004 | Hsiao | |
| 7,014,341 | B2 * | 3/2006 | King | F21S 8/02 362/241 |
| 7,055,991 | B2 | 6/2006 | Lin | |
| 7,207,697 | B2 * | 4/2007 | Shoji | F21V 5/045 362/187 |

(Continued)

FOREIGN PATENT DOCUMENTS

| | | |
|---|---|---|
| DE | 102009012138 | 9/2010 |
| DE | 102012201706 | 8/2012 |

(Continued)

OTHER PUBLICATIONS

PCT International Search Report for PCT/US2015/044438, mailed Nov. 19, 2015.

*Primary Examiner* — Laura Tso

(57) ABSTRACT

A light collimating horn assembly having two horns, one contained within the other. The horns have reflective surfaces facing each other. A light source, such as a ring of light emitting diodes, is located between the reflective surfaces of the horns. The horns at least partially collimate light from the light source transmitted between the reflective surfaces and exiting from the horns. The horns can be configured to provide controlled collimation in order to substantially collimate light for a spot light or partially but not substantially collimate light for a flood light.

20 Claims, 5 Drawing Sheets

(56) References Cited

U.S. PATENT DOCUMENTS

| | | | | |
|---|---|---|---|---|
| 7,852,460 | B2 * | 12/2010 | Bakker | B82Y 10/00 355/67 |
| 8,487,518 | B2 | 7/2013 | Johnston | |
| 8,596,825 | B2 | 12/2013 | Johnston | |
| 8,770,800 | B1 * | 7/2014 | Yriberri | F21V 7/0025 362/297 |
| 2004/0070855 | A1 | 4/2004 | Benitez | |
| 2009/0231856 | A1 | 9/2009 | Householder | |
| 2010/0254128 | A1 | 10/2010 | Pickard | |
| 2010/0295067 | A1 | 11/2010 | Vissenberg et al. | |
| 2011/0096548 | A1 | 4/2011 | Pickard | |
| 2011/0242822 | A1 * | 10/2011 | Rong | F21V 5/007 362/346 |
| 2012/0194054 | A1 | 8/2012 | Johnston | |
| 2012/0268942 | A1 | 10/2012 | Beregszaszi | |
| 2013/0077332 | A1 | 3/2013 | Hessling | |
| 2013/0194808 | A1 * | 8/2013 | Guercio | F21V 7/0025 362/296.08 |
| 2013/0235582 | A1 | 9/2013 | Breidenassel et al. | |
| 2013/0257278 | A1 | 10/2013 | DeVore | |
| 2013/0301268 | A1 | 11/2013 | Johnston | |
| 2014/0168992 | A1 | 6/2014 | Xue et al. | |
| 2014/0177230 | A1 * | 6/2014 | Rea | F21V 7/0025 362/304 |
| 2014/0328067 | A1 * | 11/2014 | Chu | G02B 27/0994 362/297 |

FOREIGN PATENT DOCUMENTS

| | | |
|---|---|---|
| EP | 0513907 | 10/1994 |
| EP | 2128660 | 12/2009 |
| EP | 2584251 | 4/2013 |
| GB | 2468118 | 9/2010 |
| JP | 2012004035 | 1/2012 |
| KR | 20120111404 | 10/2012 |
| WO | WO 01-69300 | 9/2001 |
| WO | WO 03-048634 | 6/2003 |
| WO | WO 03-087662 | 10/2003 |
| WO | WO 2004-040963 | 5/2004 |
| WO | WO 2005-078338 | 8/2005 |
| WO | WO 2006-092697 | 9/2006 |
| WO | WO 2007-016363 | 2/2007 |
| WO | WO 2008-009166 | 1/2008 |
| WO | WO 2008-089324 | 7/2008 |
| WO | WO 2008-135927 | 11/2008 |
| WO | WO 2010-089100 | 8/2010 |
| WO | WO 2011-061120 | 5/2011 |
| WO | WO 2011-125010 | 10/2011 |
| WO | WO 2011-135506 | 11/2011 |
| WO | WO 2012-038869 | 3/2012 |
| WO | WO 2012-042460 | 4/2012 |
| WO | WO 2012-049835 | 4/2012 |
| WO | WO 2012-176117 | 12/2012 |
| WO | WO 2013-005142 | 1/2013 |
| WO | WO 2013-041993 | 3/2013 |

* cited by examiner

LIGHT COLLIMATING ASSEMBLY WITH DUAL HORNS

BACKGROUND

Reflectors, designed to direct light from an omnidirectional source in a limited range of directions, are currently in existence. Search lights, stadium lights, car headlights and flashlights are examples. More recently such reflectors have been designed for light emitting diodes (LEDs), which are nearly perfect hemispherical (Lambertian) sources. These reflectors include collimating horns for LEDs, and these devices are inexpensive, easy to fabricate, have favorable optical characteristics and can use reflective films to great advantage. These horns have been used for a single LED and for an array of LEDs. The arrays of LEDs are packed together as close as possible to approximate a point source as best as possible. This configuration creates a problem with thermal management because the heat from the LEDs is concentrated and must be removed. Highly thermally conductive materials, large heat sinks, fans and liquid cooling have been used to remove the heat. Spreading the LEDs out over a larger area helps allows the heat to dissipate more readily but makes it more difficult to control the direction of the light with a single horn.

SUMMARY

A light collimating horn assembly, consistent with the present invention, includes two horns. A first horn has a first exterior surface, a first interior reflective surface forming a first interior volume, a first open end, and a second open end opposite and larger than the first open end. A second horn has a second exterior reflective surface and a second interior surface forming a second interior volume. The second horn is at least partially contained within the first interior volume with a gap between the first interior reflective surface and the second exterior reflective surface.

A light source is positioned adjacent the first open end between the first interior reflective surface and the second exterior reflective surface. The first and second horns at least partially collimate light from the light source transmitted between the first interior reflective surface and the second exterior reflective surface with the light exiting the first and second horns at the second open end.

BRIEF DESCRIPTION OF THE DRAWINGS

The accompanying drawings are incorporated in and constitute a part of this specification and, together with the description, explain the advantages and principles of the invention. In the drawings.

DETAILED DESCRIPTION

Embodiments of the present invention include a light collimating device for an array of light sources including a collimating element encompassing the light sources and at least one additional optical element disposed between the light sources to further define the light distribution pattern generated from the light sources.

Figure 1:
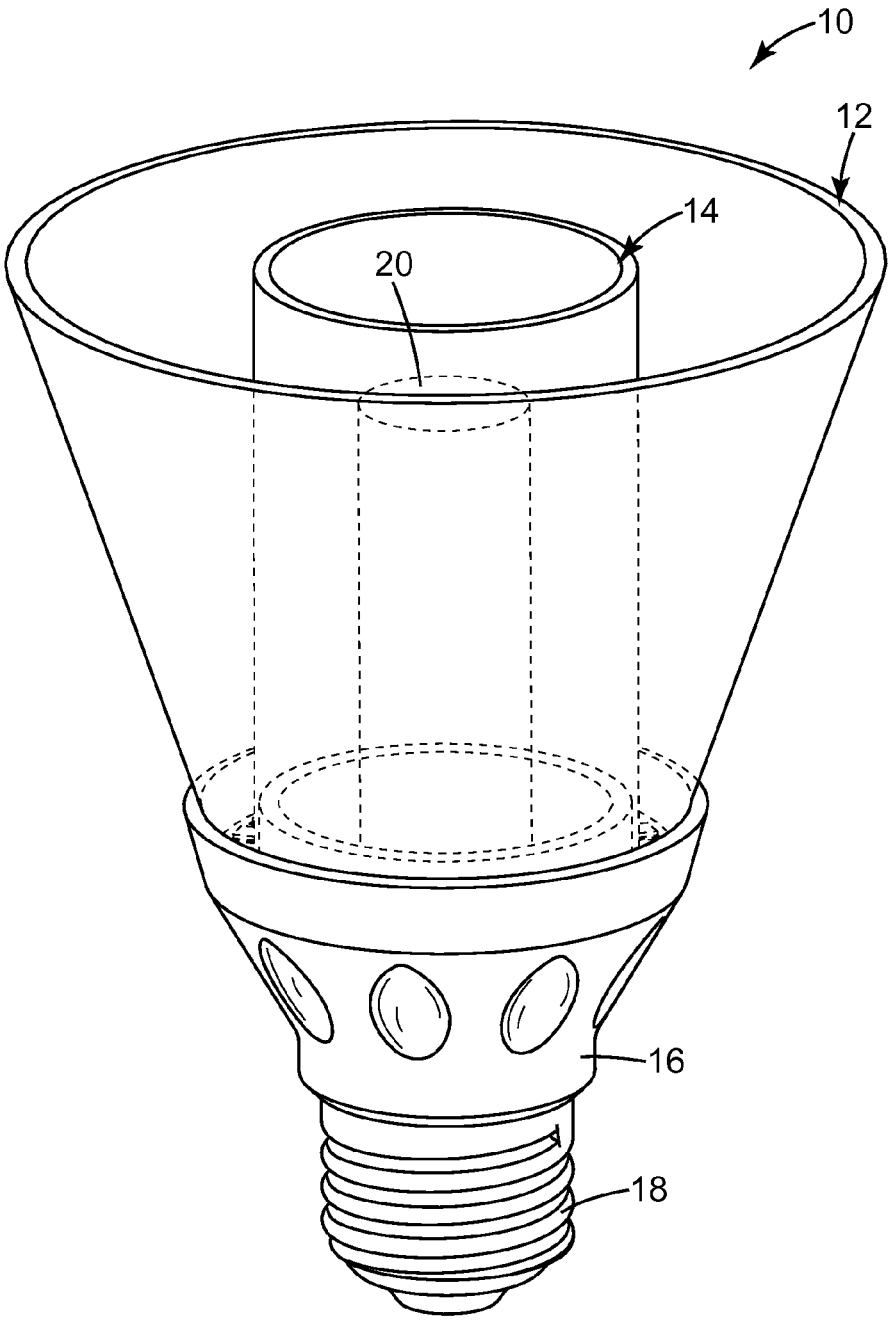
FIG. 1 is a perspective view of a light collimating assembly, as assembled.
Figure 2:
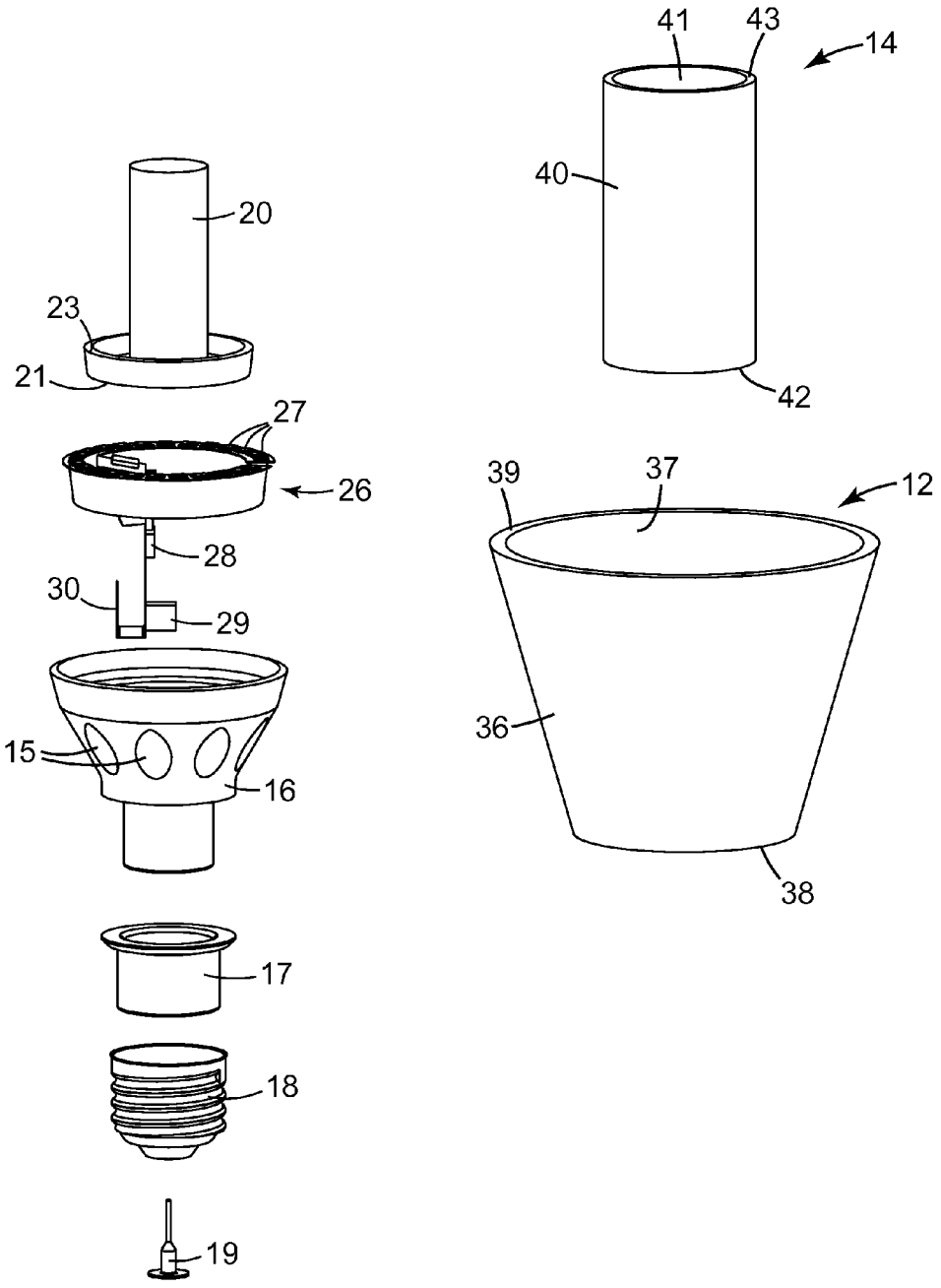
FIG. 2 is an exploded perspective view of the light collimating assembly.
Figure 3:
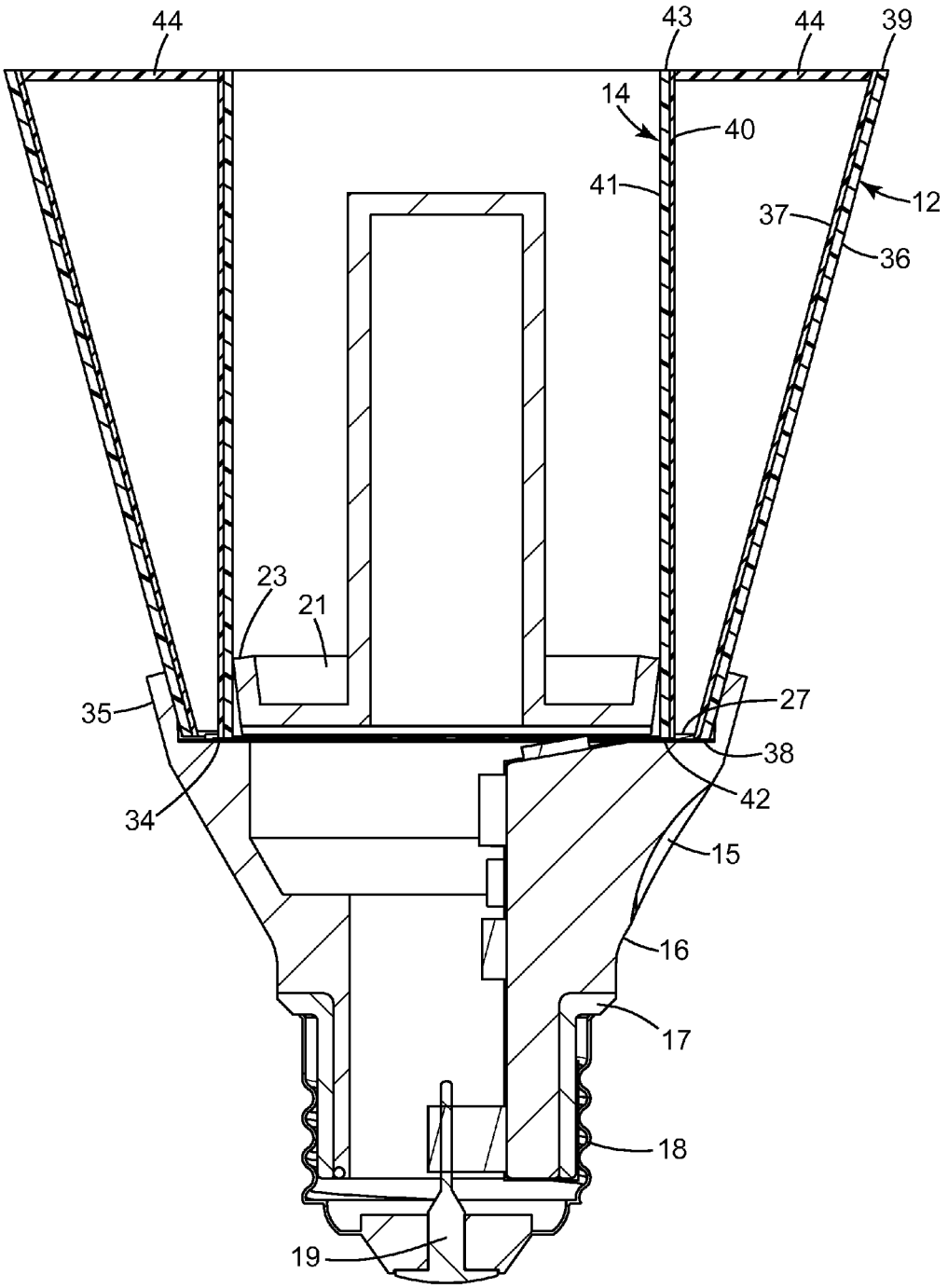
FIG. 3 is a side sectional view of the light collimating assembly.

FIG. 1 is a perspective view of a light collimating assembly 10, as assembled. FIGS. 2 and 3 are exploded perspective and side sectional views, respectively, of light collimating assembly 10. Light 10 includes an outer horn 12, an inner horn 14, a light section 16, a base 18, and an optional thermal guide 20. Outer horn 12 includes an exterior surface 36, an interior reflective surface 37 forming an interior volume, an open end 38, and an open end 39 opposite and larger than open end 38. The interior volume of outer horn 12 includes the area between open ends 38 and 39 bounded by interior surface 37. Inner horn 12 includes an exterior reflective surface 40, an interior surface 41 forming an interior volume, an open end 42, and an open end 43 opposite open end 42. The interior volume of inner horn 14 includes the area between open ends 42 and 43 bounded by interior surface 41. In this example, outer horn 12 forms a truncated cone, and inner horn 14 forms a cylinder.

A circuit board 26 includes a plurality of light sources 27, a driver circuit 28 such as an integrated circuit chip, a connector 29, and a neutral pad 30. Connector 29 is electrically connected with a pin 19 in order to receive power from a power source such as a light socket. Neutral pad 30, optionally with a neutral clip, is electrically connected with base 18.

Light sources 27 are positioned adjacent the open ends 38 and 42 between interior reflective surface 37 of outer horn 12 and exterior reflective surface 40 of inner horn 14. The outer horn 12 and inner horn 14 together at least partially collimate light from light sources 27 transmitted between interior reflective surface 37 and exterior reflective surface 40 with the light exiting the horns at open ends 39 and 43. The horns can thus provide for controlled collimation in order to, for example, substantially collimate light for a spot light or partially but not substantially collimate light for a flood light. An optional transparent or translucent cover 44 (see FIG. 3) can be located over light sources 27 at or adjacent open ends 39 and 43, and extending between outer horn 12 and inner horn 14. Cover 44 can optionally include a steering film to direct the exiting light in a particular way.

Light section 16 includes a ridge 34 for supporting light sources 27 and a portion 35 for supporting exterior surface 36 of outer horn 12. An insulator 17 is located between light section 16 and base 18. In some embodiments, light section 16 has no apertures (vents) between the horns and base 18 (see FIG. 1). Light section 16 can optionally include decorative facets or indentations 15 on its exterior surface.

Optional thermal guide 20 is at least partially contained within the interior volume of inner horn 14 for providing thermal conduction from the light sources 27 for cooling the light. Thermal guide 20 has a base 21 for placement within light section 16 and a portion 23 for supporting interior surface 41 of inner horn 14. Thermal guide 20, when used, can extend by varying or different amounts into the interior volume of inner horn 14, for example it can extend only slightly into the interior volume or extend nearly through the interior volume or extend by other amounts. An air gap is formed between at least a portion of thermal guide 20, when used, and interior surface 41 of inner horn 14. In some embodiments, the air gap substantially surrounds thermal guide 20 between thermal guide 20 and interior surface 41 of inner horn 14.

Figure 4:
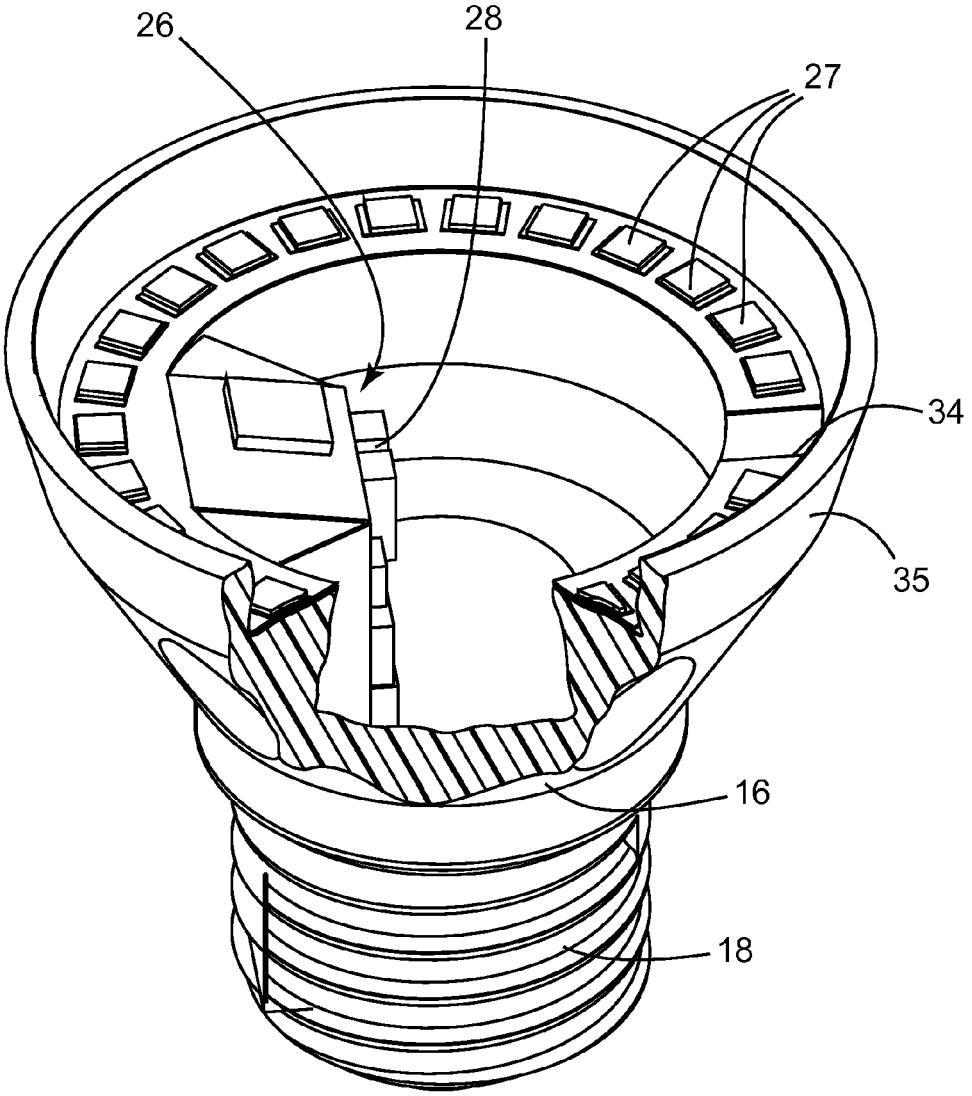
FIG. 4 is a perspective view of the light section for the light collimating assembly and illustrating LEDs on a flexible circuit board installed within the light section.
Figure 5:
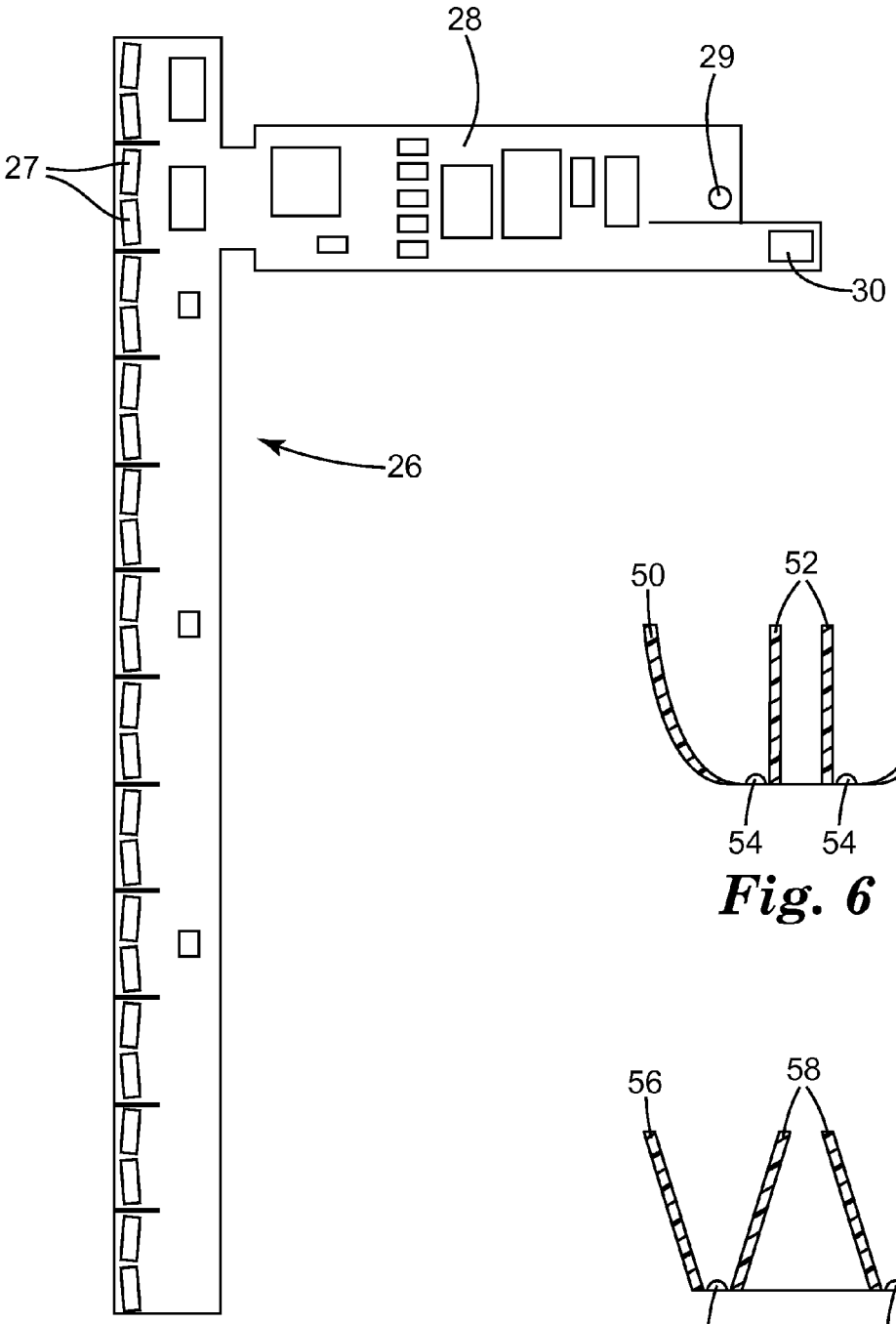
FIG. 5 is a diagram of the flexible circuit board before installation in the light section of the light collimating assembly.

FIG. 4 is a perspective view of light section 16 for light collimating assembly 10 and illustrating LEDs on circuit board 26 installed within light section 16. FIG. 5 is a diagram of circuit board 26 before installation in light section 16. In some embodiments, circuit board 26 can be implemented with a flexible one-piece material and folded for installation within light section 16. The portion of circuit board 26 with light sources 27 can be folded onto ridge 34. The portion of circuit board 26 containing driver circuit 28 can be folded to extend into an interior of light section 16. The portion of circuit board 26 containing connector 29 can be folded for electrical connection with pin 19. Connector 29 can alternatively have a different form factor to reduce the number of folds in circuit board 26. Neutral pad 30 can be folded around insulator 17 for electrical connection with base 18. In this manner, circuit board 26 can be installed in the light without requiring separate electrical connectors or circuit boards, for example. Neutral pad 30 can also function to conduct heat from circuit board 26 to base 18 to help cool the light. Circuit board 26 can alternatively be implemented, at least in part, by a circular (rigid or non-folded) board with LEDs for placement on ridge 34.

Figure 6:
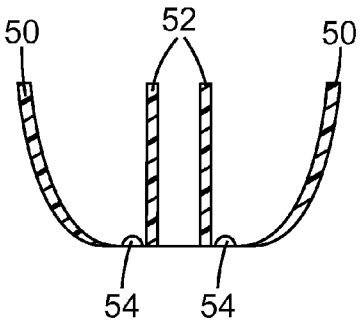
FIG. 6 is a side sectional view of alternative embodiment of the dual horns where the outer horn has a parabolic shape.
Figure 7:
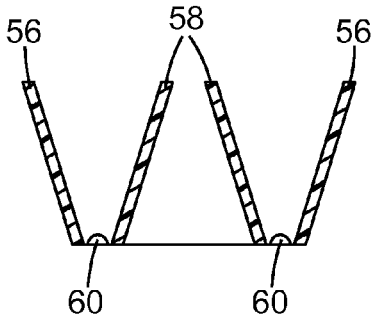
FIG. 7 is a side sectional view of an alternative embodiment of the dual horns where both horns have a truncated cone shape.

The inner and outer horns can alternatively have other configurations. FIG. 6 is a side sectional view of alternative embodiment in which outer horn 50 has a parabolic shape between its open ends, inner horn 52 has a cylindrical shape, and light sources 54 are located between opposing reflective surfaces of horns 50 and 52. FIG. 7 is a side sectional view of another alternative embodiment in which outer horn 56 forms a truncated cone, inner horn 58 also forms a truncated cone, and light sources 60 are located between opposing reflective surfaces of horns 56 and 58. The light collimating horns can also be configured in other shapes. For example, instead of the light collimating horns having a circular (or otherwise curved) cross sectional shape when viewed from the open ends, the horns can have other cross sectional shapes such as square, rectangular, or other polygonal shapes.

The following are exemplary materials, components, and configurations for the light collimating assemblies described herein.

The outer and inner horns can be implemented with aluminum or other metal materials, for example. The reflective surfaces of the horns can comprise a polished metallic surface, such as polished aluminum, or a reflective film applied to the horns. An example of a reflective film is the Enhanced Specular Reflective (ESR) film product from 3M Company, St. Paul, Minn. When implemented with a metal material, the horns can function as a heat sink in addition to collimating elements. The surfaces of the horns opposite the reflective surfaces can be painted, for example, or include a particular coating.

The light sources can be implemented with LEDs, organic LEDs (OLEDS), or other solid state light sources. The lights can include one light source or multiple light sources arranged as a ring or a curved or linear strip, for example, possibly depending upon a cross sectional shape of the light collimating horns. Also, the lights can use non-packaged LED light sources.

The driver circuit can be implemented with any circuit or component capable of receiving power from the power source and driving the light source based upon the received power. The driver circuit can be located within the assembly, as shown, or alternatively external to the assembly with an electrical connection to the light sources.

The circuit board can be implemented with any flexible board capable of fitting within the assembly and supporting the driver circuit, light sources, and possibly other components. The circuit board can be, for example, a single flexible circuit board to house those components and make electrical connections for them. The circuit board can alternatively be implemented with rigid boards, or a combination of flexible and rigid boards. As another alternative, the circuit board can support the light sources and have an electrical connection with a driver circuit located external to the assembly.

The light section can be implemented with, for example, a metal material such as aluminum. The light section can also be implemented with other metal materials, ceramic materials, thermally conductive polymers, or combinations of such materials. The light section can function as a heat sink, and a size of the light section can be adjusted to dissipate a particular amount of heat from the light. The light section can have a round or circular shape, as shown, or other shapes depending upon the shape of the horns, for example. For example, the light section can have other curved shapes or have square, rectangular, or other polygonal shapes.

The base can be implemented with, for example, an Edison base for use with conventional light bulb sockets or a base configured for connection to other types of light fixture connections. Alternatively, the assembly could be configured as a luminaire without a fixture interface such as an Edison base.

The thermal guide, when used, is in sufficient contact, directly or indirectly, with the light sources in order to conduct and dissipate heat from the light sources. The thermal guide can be directly in physical contact with the light sources or indirectly in contact with them such as through other components. The thermal guide can be implemented with a metal material such as aluminum. The thermal guide, when used, can also be implemented with other metal materials, ceramic materials, thermally conductive polymers, or combinations of such materials. The thermal guide can be hollow, as shown, or composed of a solid material, and it can include a cylindrical post, as shown, or other have other shapes extending at least partially into the interior volume of the inner horn. The thermal guide can optionally have a reflective coating.

The invention claimed is:

1. A light collimating horn assembly, comprising:

a first horn having a first exterior surface, a first interior reflective surface forming a first interior volume, a first open end, and a second open end opposite and larger than the first open end;

a second horn having a second exterior reflective surface and a second interior surface forming a second interior volume, wherein the second horn is at least partially contained within the first interior volume with a gap between the first interior reflective surface and the second exterior reflective surface; and a light source positioned adjacent the first open end between the first interior reflective surface and the second exterior reflective surface, wherein the first and second horns at least partially collimate light from the light source transmitted between the first interior reflective surface and the second exterior reflective surface, and exiting the first and second horns at the second open end.

2. The assembly of claim 1, further comprising a thermal guide at least partially contained within the second interior volume and coupled to the light source for cooling the assembly, wherein an air gap is formed between at least a portion of the thermal guide and the second interior surface.

3. The assembly of claim 2, wherein the air gap substantially surrounds the thermal guide between the thermal guide and the second interior surface.

4. The assembly of claim 1, wherein the light source includes a ring of light emitting diodes.

5. The assembly of claim 1, wherein the second horn is fully contained within the first interior volume.

6. The assembly of claim 1, wherein the first horn forms a truncated cone.

7. The assembly of claim 1, wherein the first horn has a parabolic shape between the first and second open ends.

8. The assembly of claim 1, wherein the second horn forms a cylinder.

9. The assembly of claim 1, wherein the second horn forms a truncated cone.

10. The assembly of claim 1, wherein the first horn comprises a metal material.

11. The assembly of claim 1, wherein the second horn comprises a metal material.

12. The assembly of claim 1, wherein the first interior reflective surface and the second exterior reflective surface each comprise a reflective film.

13. The assembly of claim 1, further comprising a transparent or translucent cover positioned between the first interior reflective surface and the second exterior reflective surface adjacent the second open end.

14. A light collimating horn assembly, comprising:

a base for connection to a power source;

a light section having a first side coupled to the base and a second side opposite the first side;

a first horn, coupled to the second side of the light section, having a first exterior surface, a first interior reflective surface forming a first interior volume, a first open end, and a second open end opposite and larger than the first open end;

a second horn, coupled to the second side of the light section, having a second exterior reflective surface and a second interior surface forming a second interior volume, wherein the second horn is at least partially contained within the first interior volume with a gap between the first interior reflective surface and the second exterior reflective surface; and a solid state light source positioned adjacent the first open end between the first interior reflective surface and the second exterior reflective surface, wherein the first and second horns at least partially collimate light from the solid state light source transmitted between the first interior reflective surface and the second exterior reflective surface, and exiting the first and second horns at the second open end.

15. The assembly of claim 14, wherein the first horn forms a truncated cone, and the second horn forms a cylinder.

16. The assembly of claim 14, wherein the first horn has a parabolic shape between the first and second open ends, and the second horn forms a cylinder.

17. The assembly of claim 14, wherein the first and second horn each form a truncated cone.

18. The assembly of claim 14, wherein the first and second horns each comprise a metal material.

19. The assembly of claim 14, wherein the first interior reflective surface and the second exterior reflective surface each comprise a reflective film.

20. The assembly of claim 14, further comprising a transparent or translucent cover positioned between the first interior reflective surface and the second exterior reflective surface adjacent the second open end.

* * * * *